US007201004B2

(12) United States Patent
Longsworth

(10) Patent No.: US 7,201,004 B2
(45) Date of Patent: Apr. 10, 2007

(54) PANELS FOR PULSE TUBE CRYOPUMP

(75) Inventor: Ralph C. Longsworth, Allentown, PA (US)

(73) Assignees: SHI-APD Cryogenics, Inc., Allentown, PA (US); Sumitomo Heavy Industries, Ltd., Tokyo (JP)

( * ) Notice: Subject to any disclaimer, the term of this patent is extended or adjusted under 35 U.S.C. 154(b) by 382 days.

(21) Appl. No.: 10/500,785

(22) PCT Filed: Jan. 8, 2003

(86) PCT No.: PCT/US03/00443

§ 371 (c)(1),
(2), (4) Date: Jul. 2, 2004

(87) PCT Pub. No.: WO03/057340

PCT Pub. Date: Jul. 17, 2003

(65) Prior Publication Data

US 2005/0011200 A1 Jan. 20, 2005

Related U.S. Application Data

(60) Provisional application No. 60/346,674, filed on Jan. 8, 2002.

(51) Int. Cl.
*B01D 8/00* (2006.01)
*F25D 9/00* (2006.01)

(52) U.S. Cl. ..... 62/55.5; 62/6

(58) Field of Classification Search ..... 62/6, 62/55.5

See application file for complete search history.

(56) References Cited

U.S. PATENT DOCUMENTS

| | | | | |
|---|---|---|---|---|
| 4,679,401 | A * | 7/1987 | Lessard et al. | 62/55.5 |
| 4,791,791 | A * | 12/1988 | Flegal et al. | 62/55.5 |
| 4,966,016 | A * | 10/1990 | Bartlett | 62/55.5 |
| 5,343,709 | A | 9/1994 | Kohler | |
| 5,412,952 | A | 5/1995 | Ohtani et al. | |
| 5,443,548 | A | 8/1995 | Saho et al. | |
| 6,230,499 | B1 | 5/2001 | Hohne | |
| 6,293,109 | B1 * | 9/2001 | Miyamoto et al. | 62/6 |
| 2001/0025494 | A1 * | 10/2001 | Okamura et al. | 62/6 |

FOREIGN PATENT DOCUMENTS

JP 10-184540 * 7/1998

* cited by examiner

*Primary Examiner*—William C. Doerrier
(74) *Attorney, Agent, or Firm*—Katten Muchin Roseman LLP

(57) ABSTRACT

The pulse tubes (165, 175) and regenerators (160, 170) contained within a cryopump housing (210) are arranged in a way that facilitates the fabrication and installation of the cryopanels (265). The pulse tubes and regenerators are located in a common plane in the center of the cryopump housing and the cold (second stage) panels (265) that are pitched parallel to the plane with the tubes.

15 Claims, 7 Drawing Sheets

PANELS FOR PULSE TUBE CRYOPUMP

This application is the National Stage of International Application No. PCT/US03/00443, filed Jan. 8, 2003, which claims the benefit under 35 U.S.C. 119(e) of U.S. Provisional Application No. 60/346,674, filed Jan. 8, 2002.

BACKGROUND OF THE INVENTION

The Gifford-McMahon (G-M) type pulse tube refrigerator is a cryocooler, similar to G-M refrigerators, that derives cooling from the compression and expansion of gas. However, unlike the G-M systems, in which the gas expansion work is transferred out of the expansion space by a solid expansion piston or displacer, pulse tube refrigerators have no moving parts in their cold end, but rather an oscillating gas column within the pulse tube that functions as a compressible displacer. The elimination of moving parts in the cold end of pulse tube refrigerators allows a significant reduction of vibration, as well as greater reliability and lifetime, and is thus potentially very useful in cooling cryopumps, which are often used to purge gases from semiconductor fabrication vacuum chambers.

G-M type pulse tube refrigerators are characterized by having a compressor that is connected to a remote expander by high and low pressure gas lines. The pulse tube expander has a valve mechanism that alternately pressurizes and depressurizes the regenerators and pulse tubes to produce refrigeration at cryogenic temperatures.

Two stage G-M refrigerators, which are presently being used to cool cryopumps, cool a first stage cryopanel at about 60 K and a second stage cryopanel at about 15 K. The expander is usually configured as a stepped cylinder with a valve assembly at the first stage warm end, a first stage cold station (60 K) at the transition from the larger diameter first stage to the smaller diameter second stage, and a second stage cold station (15 K) at the far end. The cryopanels are typically axi-symetric around the cold finger. The cryopump operates equally well in all orientations.

Longsworth, U.S. Pat. No. 4,150,549, dated Apr. 24, 1979 and entitled "Cryopumping Method and Apparatus", describes a typical cryopump that uses a two stage G-M refrigerator to cool two axi-symetric cryopanels. The first stage cools an inlet (warm) panel that pumps group I gases, e.g. $H_2O$, and blocks a significant amount of radiation from reaching the second stage (cold) panel but allows group II, e.g. $N_2$, and m, e.g. $H_2$, gases to pass through it. The Group II gases freeze on the front side of the cold panel(s) and Group III gases are adsorbed in an adsorbent on the backside of the cold panel(s).

Unlike a typical GM expander that has a single stepped cylinder that lends itself to attaching axi-symetric cryopanels, the two stage pulse tube expander has two pulse tubes and two or more tubes to house the regenerators. The pulse tubes themselves tend to be as long as the most common size cryopump which has a diameter of 200 mm. G-M type pulse tube refrigerators that operate below 20 K have the disadvantage of requiring that the hot end of the pulse tube be above the cold end in order to avoid the thermal losses associated with convective circulation within the pulse tube. Conventional two-stage GM type pulse tube refrigerators typically have the valve mechanism and the hot end of the pulse tube on top. This enables the heat that is rejected at the hot end of the pulse tube to be easily transferred to the low-pressure gas and returned to the compressor where it is rejected.

Most cryopumps are mounted below the vacuum chamber where space above the cryopump housing is very limited. Having the valve mechanism above the cryopump housing limits the applications of the cryopump. Thus, any options to orient the pulse tube refrigerator with the valve behind or below a cryopump housing that has a side inlet are highly desirable. The first and second stage pulse tubes are two separate tubes that have two or three regenerator tubes with them. The arrangement of the pulse tubes and regenerators in the cryopump housing makes it very difficult to make conventional axi-symetric cryopanels because they have so many cut outs to fit around the tubes. This problem has not been recognized or solved in the prior art.

It is an object of the present invention to provide an arrangement of the tubes within the cryopump housing that facilitates the fabrication and installation of the cryopanels.

SUMMARY OF THE INVENTION

The present invention has two essential features. First, the pulse tubes and regenerators are located in a common plane in the center of the cryopump housing, and second, the cold (second stage) panel(s) are in planes that are pitched parallel to the plane with the tubes, (a line can be drawn on a cryopanel surface that is parallel to the line where the plane of the tubes intersects the inlet plane). This arrangement simplifies the construction of the cryopanels and enables the cryopanels to be mounted more easily.

It is preferred that the cryopump housing be generally cylindrical with a horizontal centerline and an inlet on one end. The pulse tube valve assembly is either below the housing or mounted on the end plate opposite the inlet. The pulse tubes used to illustrate this invention have two separate pulse tube and regenerator assemblies, and operate with passive interphase control and a buffer volume. The hot ends of the pulse tubes are an integral part of the cryopump housing and the buffer volume is external to the housing.

If the inlet to the cryopump is parallel to the pulse tubes then the first stage pulse tube may be in front of or behind the second stage pulse tube. It is preferred that the first stage is behind the second stage so that the cold panel shields the temperature gradients in both pulse tubes from freezing gases at intermediate temperatures where they can cause undesirable pressure transients when the gas load changes.

The first stage panel, or shield, is generally cup shaped with a small gap between the panel and cryopump housing. It may have some cut outs to fit around the pulse tubes when being installed. It serves to shield the second stage panel from radiant heat and may also serve to transport heat from the inlet louver. It is connected to the first stage cold station by a thermal bus. When the first stage pulse tube is behind the second stage pulse tube the thermal bus is parallel to the second stage pulse tube. When the first stage pulse tube is in front of the second stage pulse tube the orientation of the thermal bus is optional. In this case the thermal bus also cools the inlet louvers.

Inlet louvers are conventionally pitched at about 45° and are circular (truncated cones), but they may be straight, or transverse to the inlet in the form of a grid.

In the preferred embodiment with the second stage pulse tube in front of the first stage pulse tube the second stage cryopanels can be a group of simple flat plates folded over with different pitches, and attached to, the cold station. They are oriented parallel to both pulse tubes. When the first stage is in front of the second stage the second stage cryopanel can consist of two separate but identical assemblies that each has a plate that attaches to the second stage cold station and extends along side the first stage pulse tube. Flat fins extend from the base plate to provide the cryopumping surface.

An example is also given of a conventional two-stage pulse tube that has the valve assembly on top, with the pulse tubes and regenerators oriented hot ends up, cold ends down. The cryopump inlet is on the bottom. The design is unconventional in having all of the tubes in a common plane so the second stage cryopanel can consist of flat plates that are pitched parallel to the same centerline.

DETAILED DESCRIPTION OF THE INVENTION

Figure 1A:
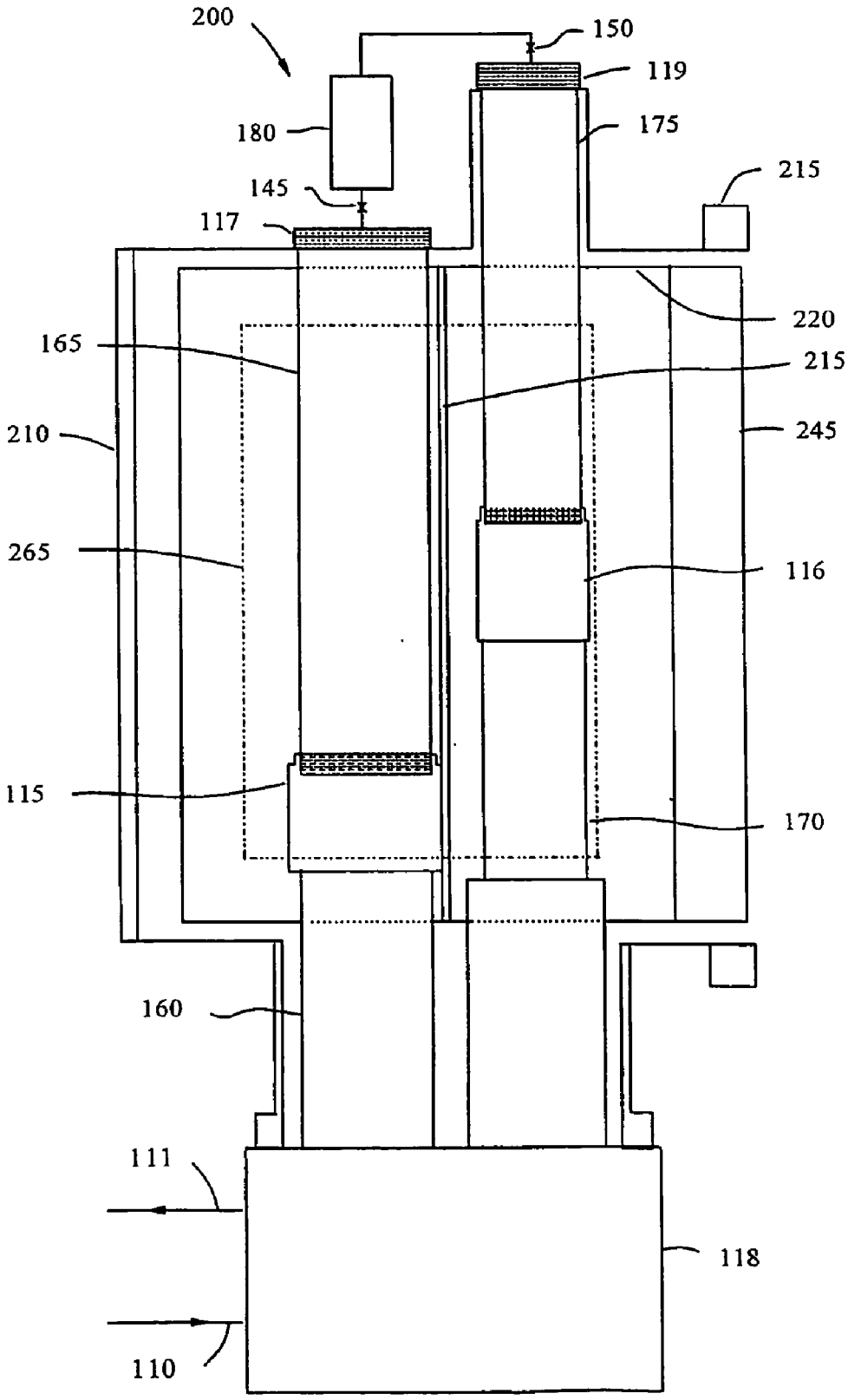
FIG. 1A is a cross section of a first embodiment of a cryopump with a two stage pulse tube that has the pulse tubes in a common plane and the second stage pulse tube between the inlet louver on one side and the first stage pulse tube on the other. The valve assembly is on the bottom.

FIG. 1A is a cross section of a first embodiment of a cryopump, cryopump 200, with cryopanels cooled by a two-stage pulse tube refrigerator. The pulse tubes are oriented vertically; pulse tube hot ends up, in line with their respective regenerators, and mounted in a common vertical plane that includes the horizontal axis of the housing. Cryopump 200 includes housing 210, inlet flange 215, first stage regenerator 160, first stage cold station 115, first stage pulse tube 165, first stage hot station 117, restrictor 145, second stage regenerator 170, second stage cold station 116, second stage Pulse tube 175, second stage hot station 119, restrictor 150, valve assembly 118, gas inlet 110, gas outlet 111, cryopump inlet grid 245, radiation shield 220, thermal bus 215, and second stage cryopanel 265. The pressure in the two pulse tubes cycles 180° out of phase, with gas being exchanged at the hot ends through flow restrictors 145 and 150, with buffer tank 180 in between. The hot ends of the pulse tubes are an integral part of the top of the cryopump housing and extend through the wall to facilitate the rejection of heat and the connection of control piping. FIG. 1A shows the preferred embodiment in which the second stage pulse tube is located between the inlet grid on one side and the first stage pulse tube on the other. The valve assembly is on the bottom.

Figure 1B:
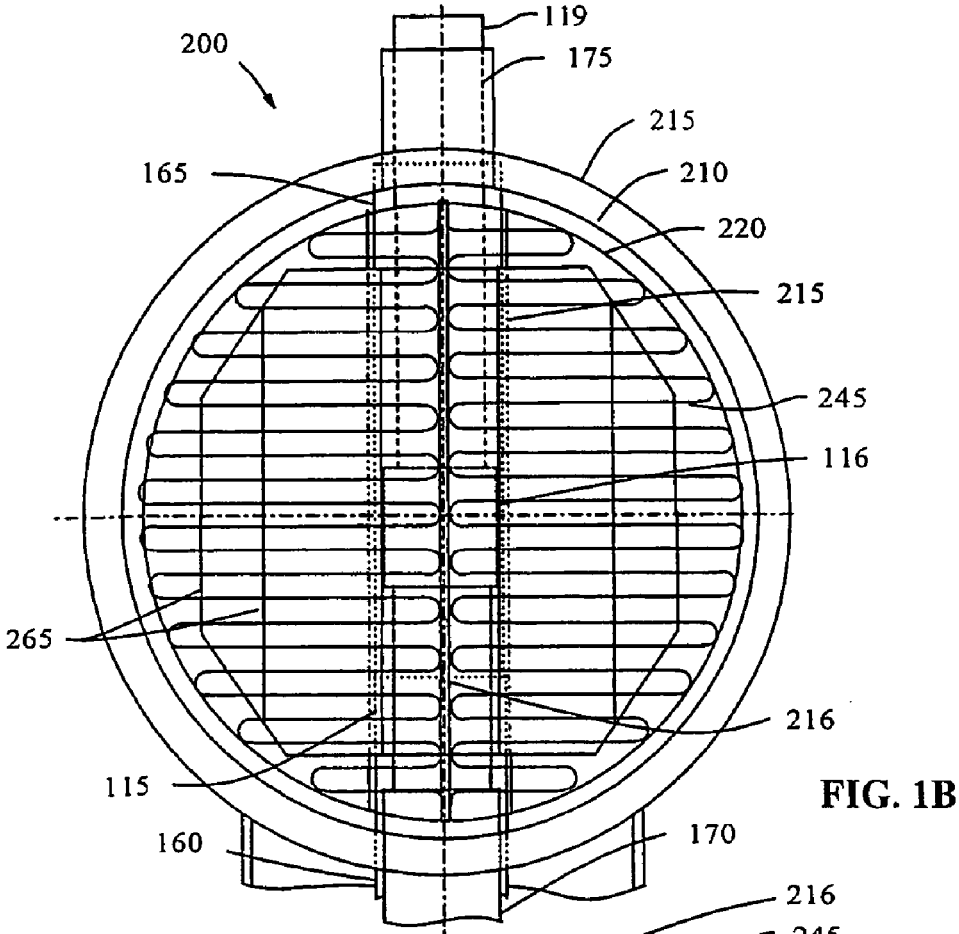
FIG. 1B is a view of the cryopump of FIG. 1A from the front, or inlet side.

FIG. 1B is a view of cryopump 200 from the front, or inlet side. Component callouts are the same as FIG. 1A. The inlet grid 245 consists of a long ribbon, about 1.5 cm wide made of a material with a high thermal conductivity, such as Cu, which may be formed into the shape shown. The ribbon is mechanically and thermally connected to a strip of Cu in the middle, thermal bus 216, and to shield 220 on the circumference. Grid 245 will freeze out most of the water vapor in the air entering the pump. The top of cryopanel 265, which is attached to the second stage cold station 116, is seen through the inlet grid. The second stage pulse tube assembly is directly behind cryopanel 265 and the first stage pulse tube assembly is behind that.

Figure 1C:
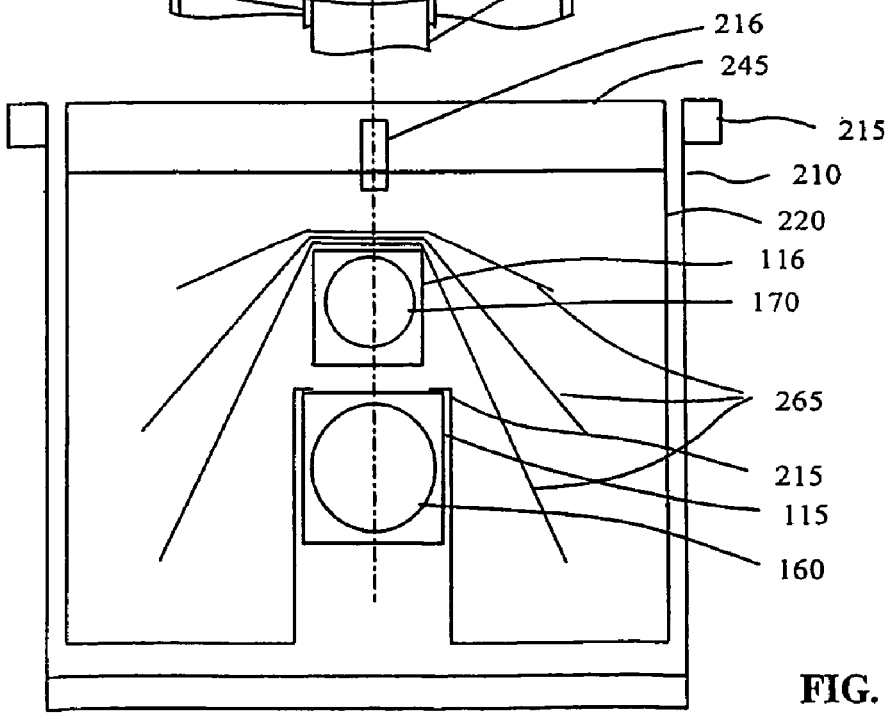
FIG. 1C is a view of the cryopump of FIG. 1A from the bottom, showing a cross section through the regenerators, cryopanels, and housing.

FIG. 1C is a cross section view of cryopump 200 from the bottom, showing the regenerators, cryopanels, and housing. This is the best view to illustrate the essential principles of this invention and the preferred embodiment. The second stage pulse tube assembly, as represented by cold station 116 and regenerator 170, and first stage pulse tube assembly, as represented by cold station 115 and regenerator 160, are in a common vertical plane that includes the axis of the housing. The second stage cryopanel 265 is a series of flat plates pitched at different angles that extend parallel to, and on the inlet side of, the second stage pulse tube. Shield 220 is split into two halves, each half being attached to cold station 115 by thermal bus 215, which extends from one side of the shield to the other. Grid 245 and thermal bus 216 are attached at the inlet end of shield 220.

Figure 2:
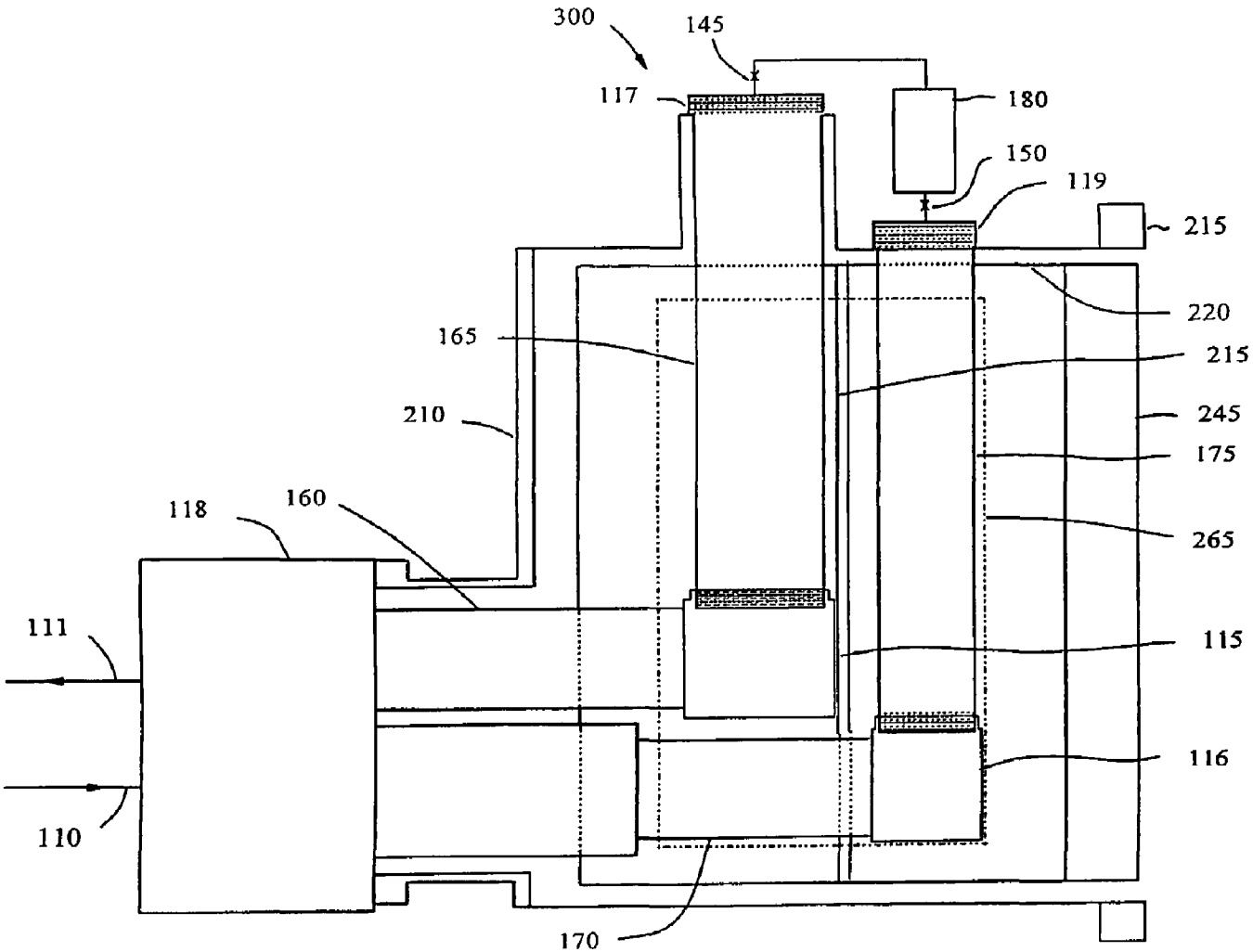
FIG. 2 is a cross section of a second embodiment of a cryopump with a two stage pulse tube that has the pulse tubes in a common plane and the second stage pulse tube between the inlet louver on one side and the first stage pulse tube on the other. The valve assembly is on the backside, opposite the inlet.

FIG. 2 shows a second embodiment of a cryopump, cryopump 300, with a two stage pulse tube that has the pulse tubes in a common plane and the second stage pulse tube between the inlet louver on one side and the first stage pulse tube on the other. The valve assembly is on the backside, opposite the inlet. The component designations are the same as FIG. 1A. The cryopanel arrangements are the same as FIGS. 1B and 1C. Cryopump 300 differs from cryopump 200 in that regenerator 160 and regenerator 170 are parallel to the centerline of the cryopump housing 210, perpendicular to the inlet grid 245, and are mounted at the warm end to valve assembly 118. This arrangement minimizes the top to bottom height of the cryopump.

Figure 3A:
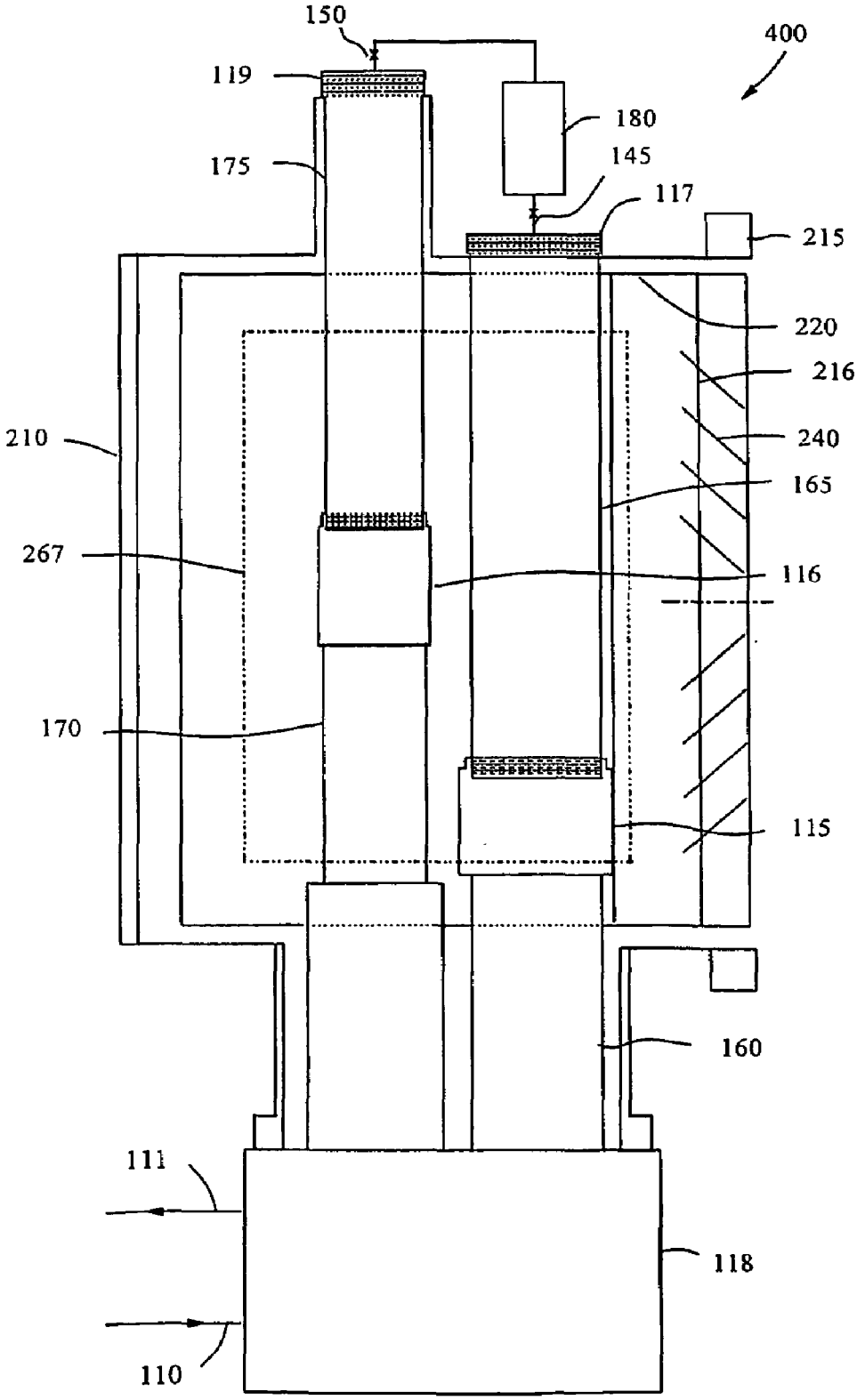
FIG. 3A is a cross section of a third embodiment of a cryopump with a two stage pulse tube that has the pulse tubes in a common plane and the first stage pulse tube between the inlet louver on one side and the second stage pulse tube on the other. The valve assembly is on the bottom.

FIG. 3A is a cross section of a third embodiment of a cryopump, cryopump 400, with cryopanels cooled by a two-stage pulse tube refrigerator. The pulse tubes are in line with their respective regenerators, and mounted in a common plane that includes the horizontal axis of the housing. Cryopump 400 differs from cryopump 200 in that the location of the pulse tube assemblies is interchanged. This embodiment has the first stage pulse tube located between the inlet grid on one side and the second stage pulse tube on the other. Cryopump 400 includes housing 210, inlet flange 215, first stage regenerator 160, first stage cold station 115, first stage pulse tube 165, first stage hot station 117, restrictor 145, second stage regenerator 170, second stage cold station 116, second stage pulse tube 175, second stage hot station 119, restrictor 150, valve assembly 118, gas inlet 110, gas outlet 111, cryopump inlet louver 240, radiation shield 220, thermal bus 216, and second stage cryopanel 267. The pressure in the two pulse tubes cycles 180° out of phase with gas being exchanged at the hot ends through flow restrictors 145 and 150, with buffer tank 180 in between. The hot ends of the pulse tubes are an integral part of the top of the cryopump housing and extend through the wall to facilitate the rejection of heat and the connection of control piping. The valve assembly is on the bottom.

Figure 3B:
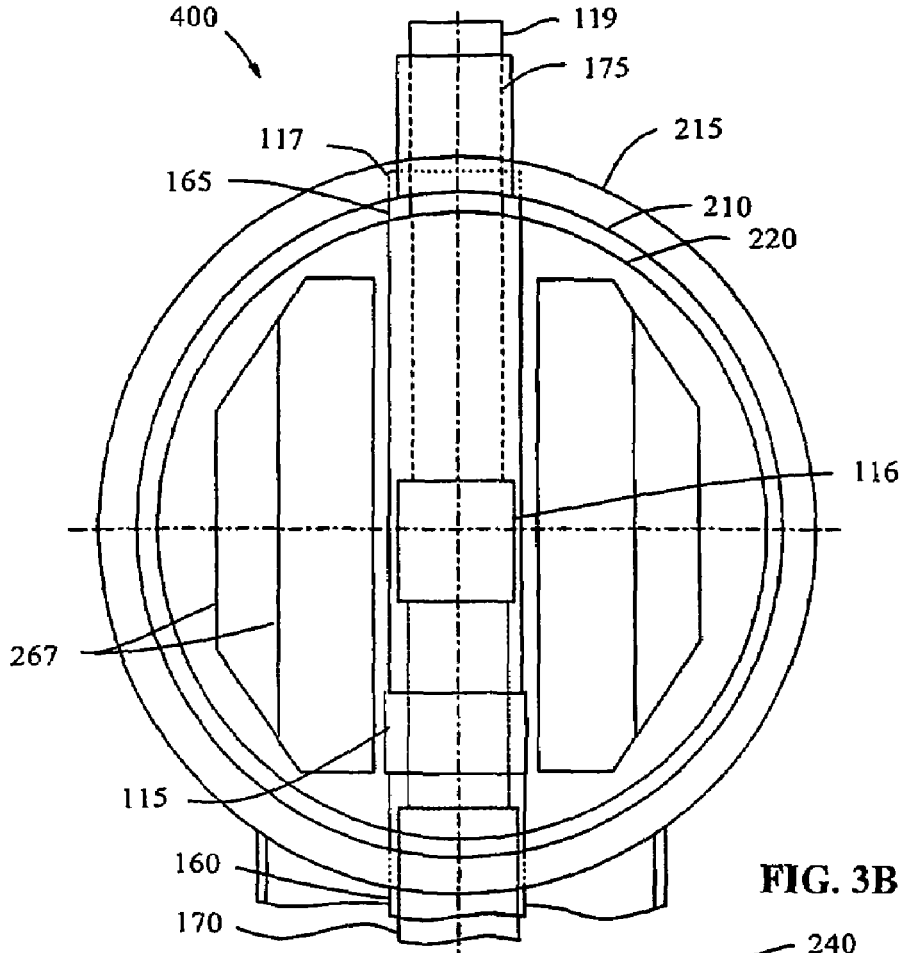
FIG. 3B is a view of the cryopump of FIG. 3A from the front, or inlet side, with the inlet louver removed.

FIG. 3B is a view of cryopump 400 from the front, or inlet side, with inlet louver 240 and thermal bus 216 removed. The component callouts are the same as FIG. 3A.

Figure 3C:
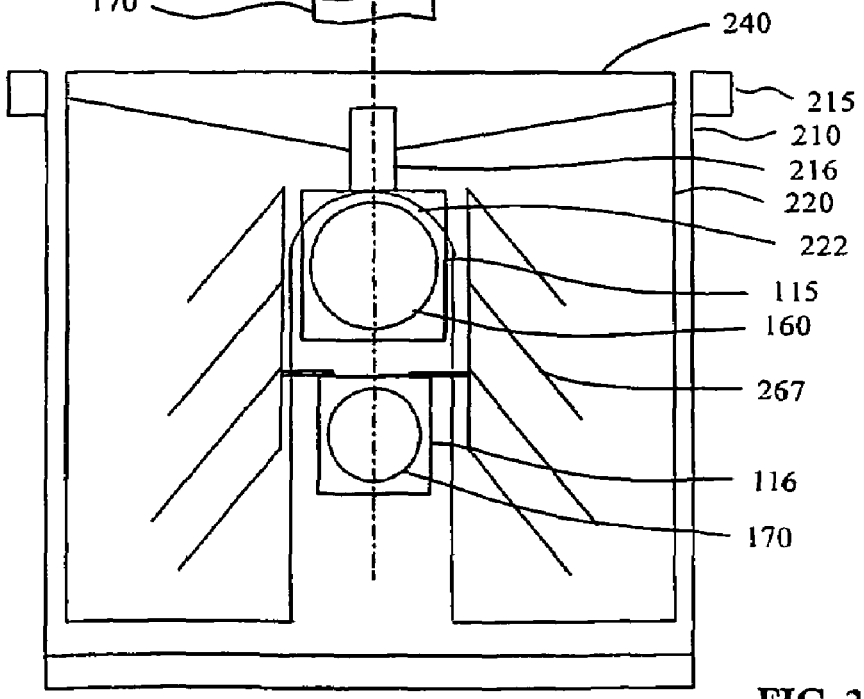
FIG. 3C is a view of the cryopump of FIG. 3A from the bottom, showing a cross section through the regenerators, cryopanels, and housing.

FIG. 3C is a view of cryopump 400 from the bottom, showing a cross section through the regenerators, cryopanels, and housing. This view illustrates the essential principals of this invention. The second stage pulse tube assembly, as represented by cold station 116 and regenerator 170, is in line with the first stage pulse tube assembly, as represented by cold station 115 and regenerator 160, and the second stage cryopanel 265 is a series of flat plates pitched at different angles that extend parallel to the second stage pulse tube. Shield 220 is slotted at both sides so it can be fitted over the pulse tubes and regenerators when it is installed from the inlet side. Another panel, that is not shown, might be installed to cover the slot. Thermal bus 216 extends from one side of shield 220 to the other. It is attached to cold station 115, shield 220, and louver 240. A second shield 222, which is also cooled by cold station 115, extends over the cold sections of pulse tube 165 and regenerator 160 to prevent gases from freezing out at intermediate temperatures. Cold stations 115 and 116, cryopanel 267, shields 220 and 222, thermal bus 216, and louver 240, are all made of a metal with high thermal conductivity, such as Cu.

Cryopanel 267 consists of two halves that are attached to either side of second stage cold station 116. The individual louvers of louver 240 are shown as being tapered. Looking at Louver 240 straight on would show the louvers to be overlapped in the center, and to have gaps of increasing width as the outer edge is approached. This provides essentially the same gas flow pattern as the typical louvers that are presently being used, which are quite open in the outer region. Straight louvers of constant width and circular louvers can also be used.

Figure 4:
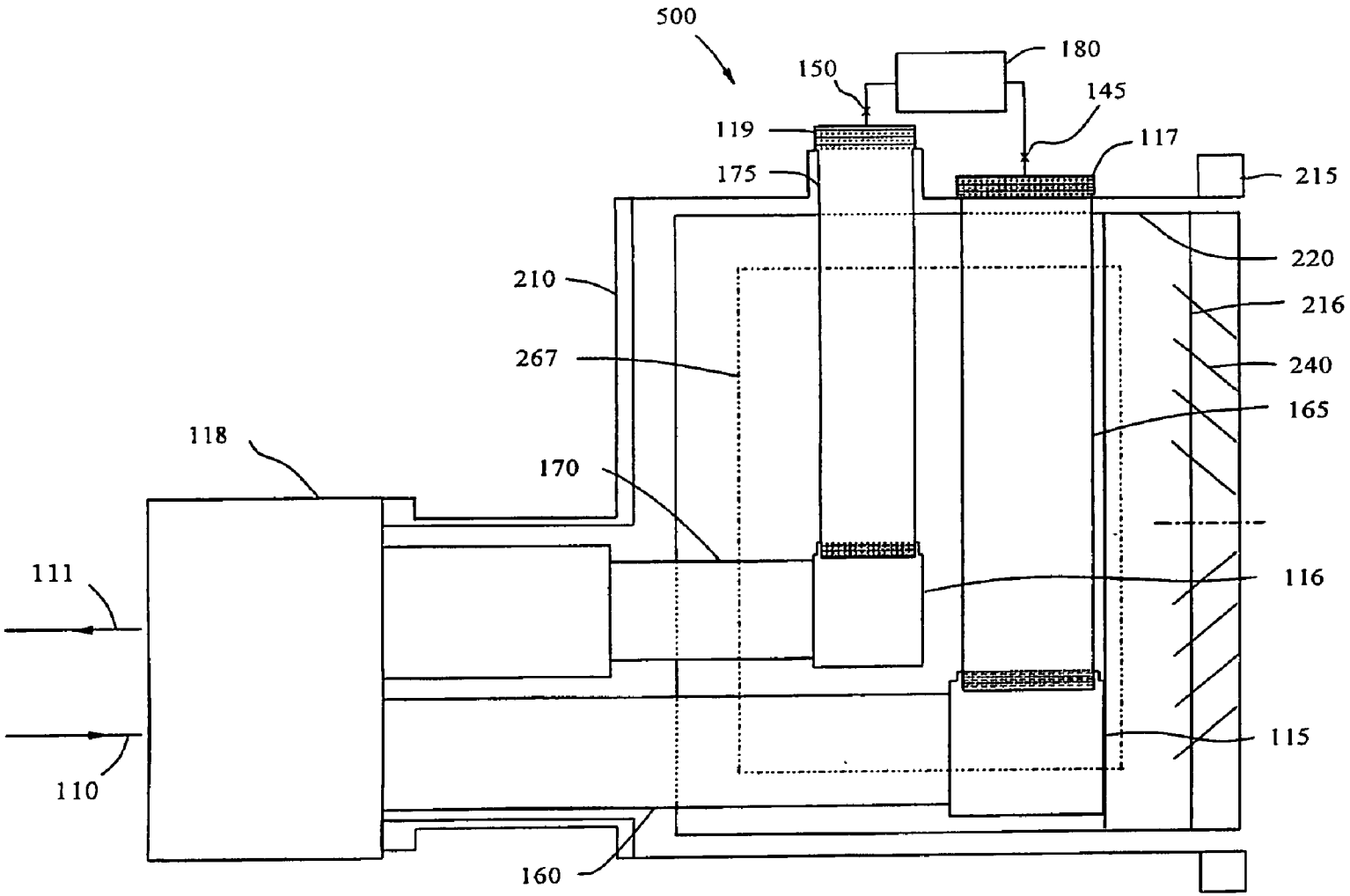
FIG. 4 is a cross section of a fourth embodiment of a cryopump with a two stage pulse tube that has the pulse tubes in a common plane and the first stage pulse tube between the inlet louver on one side and the second stage pulse tube on the other. The valve assembly is on the backside, opposite the inlet.

FIG. 4 is a cross section of cryopump 500 which is a fourth embodiment of a cryopump with a two stage pulse tube that has the pulse tubes in a common plane and the first stage pulse tube between the inlet louver on one side and the second stage pulse tube on the other. The valve assembly is on the backside, opposite the inlet. The component designations are the same as FIG. 3A. The cryopanel arrangements are the same as FIGS. 3B and 3C. Cryopump 500 differs from cryopump 400 in that regenerator 160 and regenerator 170 are parallel to the centerline of the cryopump housing 210, perpendicular to the inlet louver 240, and are mounted at the warm end to valve assembly 118. This arrangement minimizes the top to bottom height of the cryopump.

Figure 5:
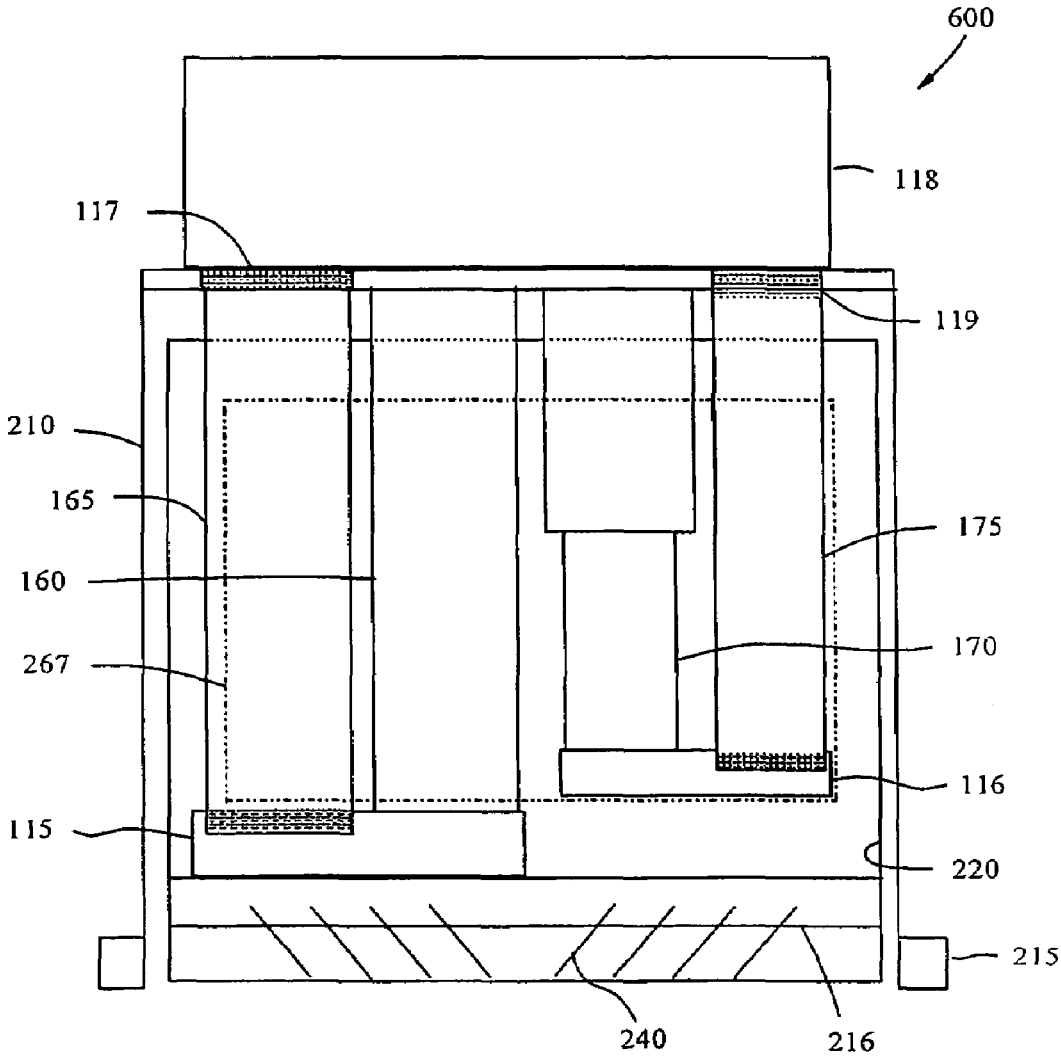
FIG. 5 is a cross section of a fifth embodiment of a cryopump with a two-stage pulse tube that has the pulse tubes and regenerators in a common plane. The valve assembly is on the top, opposite the inlet, which is on the bottom.

The most common configuration of a two stage GM type pulse tube is a warm end base with the valve assembly mounted above it and the pulse tubes and regenerators mounted below it. The cold ends are at the bottom, and the hot ends are connected to the base and valve assembly. FIG. 5 shows cryopump 600, which incorporates the basic features of a conventional two stage GM type pulse tube, but the pulse tubes and regenerators are in a common plane, in accordance with the present invention. The second stage cryopanels are flat, pitched, surfaces that are essentially the same as those shown in FIGS. 3B and 3C but the orientation is parallel to the plane of the pulse tubes and regenerators rather than parallel to the second stage pulse tube. The inlet to cryopump 600 is on the bottom. The configuration shown in FIG. 5 has the first stage cold station 115 between inlet louver 240 and cold station 116, thus the similarity of the cryopanels to cryopump 400. The component designations are the same as cryopump 400.

It is equally possible to have cold station 116 between inlet louver 240 and cold station 115. This would result in a cryopanel geometry that is essentially the same as shown in FIGS. 1A and 1B. The use of an inlet louver or a grid is a designers' choice.

It is understood that it is within the scope of this description to allow for the pulse tubes and regenerators to be generally in a plane and for the cryopanels to be generally flat.

The invention claimed is:

1. A refrigeration system comprising a cryopump, a cryopump housing having a cryopump inlet in the housing, at least two cryopanels, at least two pulse tubes and at least two regenerators where the pulse tubes and regenerators are located in a common plane in the center of the cryopump housing and essentially all of the surface of the last stage cryopanel lies in a plane such that a line can be drawn on a cryopanel surface that is parallel to the line where the plane of the tubes intersects the cryopump inlet plane.

2. A refrigeration system comprising a cryopump, a cryopump housing having a cryopump inlet in the housing, at least two cryopanels, at least two pulse tubes, at least two regenerators and a pulse tube valve assembly where the pulse tubes and regenerators are located in a common plane in the center of the cryopump housing and essentially all of the surface or the last stage cryopanel lies in a plane that intersects the plane with the tubes pitched parallel to the coldest pulse tube.

3. The refrigeration system of claim 2 where a first stage pulse tube is located between the cryopump inlet and a second stage pulse tube and the pulse tube valve assembly is located below the cryopump housing or at the side of the cryopump opposite the cryopump inlet.

4. The refrigeration system of claim 3 where the valve assembly is located at the side of the cryopump housing opposite the cryopump inlet.

5. The refrigeration system of claim 3 where the valve assembly is located below the cryopump housing.

6. The refrigeration system of claim 2 where a second stage pulse tube is located between the cryopump inlet and a first stage pulse tube and the pulse tube valve assembly is located below the cryopump housing or at the side of the cryopump opposite the cryopump inlet.

7. The refrigeration system of claim 6 where the valve assembly is located at the side of the cryopump housing opposite the cryopump inlet.

8. The refrigeration system of claim 6 where the valve assembly is located below the cryopump housing.

9. The refrigeration system of claim 2 also comprising a thermal bus.

10. The refrigeration system of claim 9 where the thermal bus is parallel to the pulse tube positioned closest to the cryopump inlet.

11. The refrigeration system of claim 2 also comprising a buffer volume where the hot ends of the pulse tubes are integral to the cryopump housing and the buffer volume is external to the housing.

12. The refrigeration system of claim 2 where the cryopump housing is generally cylindrical in shape, has a horizontal centerline and has an inlet on the end of the housing.

13. The refrigeration system of claim 2 where the second stage cryopanels are flat plates folded over with different pitches.

14. The refrigeration system of claim 13 where the second stage cryopanels are attached to the cold station of the second stage regenerator.

15. A refrigeration system comprising a cryopump, a cryopump housing having a cryopump inlet in the housing, at least two cryopanels, at least two pulse tubes and at least two regenerators where the pulse tubes and regenerators are located in a common plane in the center of the cryopump housing and a surface of the last stage cryopanel lies in a plane that intersects the plane with the tubes parallel to who coldest pulse tube.

* * * * *